US006214475B1

(12) United States Patent
Bamberg et al.

(10) Patent No.: US 6,214,475 B1
(45) Date of Patent: Apr. 10, 2001

(54) THERMAL INSULATING LAYER FOR A METALLIC COMPONENT AND ITS PROCESS OF MANUFACTURE

(75) Inventors: Joachim Bamberg; Peter Adam, both of Dachau (DE)

(73) Assignee: Daimler-Benz AG, Munich (DE)

( * ) Notice: Subject to any disclaimer, the term of this patent is extended or adjusted under 35 U.S.C. 154(b) by 0 days.

(21) Appl. No.: 09/165,721

(22) Filed: Oct. 2, 1998

(30) Foreign Application Priority Data

Oct. 2, 1997 (DE) ..... 197 43 579

(51) Int. Cl.[7] ..... B32B 9/00; C23C 4/10

(52) U.S. Cl. ..... 428/469; 428/472; 427/348; 427/453

(58) Field of Search ..... 428/312.8, 469, 428/472; 427/446, 453, 454, 348

(56) References Cited

U.S. PATENT DOCUMENTS 5,089,066 * 2/1992 Hamada et al. ..... 148/302
5,277,936 1/1994 Olson et al. .
5,316,595 * 5/1994 Hamada et al. ..... 148/302
5,534,308 * 7/1996 Bamberg et al. ..... 427/454
5,674,616 * 10/1997 Balcar ..... 428/402
5,721,057 * 2/1998 Bamberg et al. ..... 428/469
5,776,588 * 7/1998 Moriguchi et al. ..... 428/210
5,851,409 * 12/1998 Schaeffer et al. ..... 216/2
6,042,898 * 3/2000 Burns et al. ..... 427/534

FOREIGN PATENT DOCUMENTS 4041103 7/1992 (DE) .
5-271900 * 10/1993 (JP) .

* cited by examiner

*Primary Examiner*—Timothy M. Speer
*Assistant Examiner*—Bryant Young
(74) *Attorney, Agent, or Firm*—Ladas and Parry

(57) ABSTRACT

A process for the manufacture of a thermo-mechanically stable thermal insulating layer, in which a ceramic thermal insulating layer is applied to a metallic component by thermal spraying and the thermal insulating layer is shot peened during and/or after its application in order to reduce sintering effects. The ceramic thermal insulating layer has a porous structure which is opened up by the formation of microscopic fissures formed near the surface of the layer by the shot peening.

6 Claims, No Drawings

THERMAL INSULATING LAYER FOR A METALLIC COMPONENT AND ITS PROCESS OF MANUFACTURE

FIELD OF THE INVENTION

The invention relates to a thermal insulating layer of ceramic material, which is applied to a metallic component by means of thermal spraying and which has a porous structure. The invention also relates to the manufacture of such components with insulating layers.

BACKGROUND

During the assembly of engines and turbines, the highly stressed metallic components are provided with ceramic thermal insulating layers in order to protect them from high temperatures. The thermal insulating layers can be applied to the metallic components in a manner, which is the most effective and favorable in terms of cost, by means of thermal spraying, such as, for example, plasma spraying. The ceramic insulating layers, which have been prepared in this way, possess a porous structure which has microscopic fissures running through it, whereby the structure has a reduced modulus of elasticity. As a consequence, the thermal insulating layer can withstand, without damage to a limited extent, the deformations which constantly arise as a consequence of thermo-mechanical stress during operation. However, the ceramic is changed when the thermal insulating layer is exposed to high temperatures exceeding 900° C. Sintering effects arise which lead, as a consequence, to an increased modulus of elasticity. The thermal insulating layer is thus less tolerant with respect to expansion so that the thermo-mechanical stresses lead to so-called segmentation fissures, as a result of which the thermal insulating layer becomes segmented into individual flakes.

In the case of ceramic thermal insulating layers, which have become segmented in this way, simulation calculations and experiments have shown that progression of the fissures toward the interface with the metallic component (metal substrate) occurs during further thermo-mechanical stressing. This progression of the fissures leads to pieces flaking off and hence to the complete failure of the thermal insulating layer.

A process is known from DE 40 41 103 A1 for surface treating structural components by means of shot peening with spherical particles in which a metallic MCrAlY layer is initially applied, in the form of an oxidation layer and hot-gas corrosion layer, to the surface of the structural component and the surface is then shot peened with spherical particles to achieve smoothing of the rough surface of the layer and compacting of the layer. Such a metallic layer is homogeneous and differs fundamentally from a ceramic thermal insulating layer which exhibits grains and grain boundaries.

U.S. Pat. No. 5,277,936 discloses a process for coating a structural component which comprises a basic Ni or Co alloy in which a metallic powder and oxides for the manufacture of a metallic anti-oxidation layer/adhesive surface for a thermal insulating layer are applied by means of plasma spraying. The anti-oxidation layer/adhesive surface is peened in order to achieve compactness. The ceramic thermal insulating layer itself should not be peened.

SUMMARY OF THE INVENTION

An object of the invention is to improve a thermal insulating layer of the type, which was described above, in such a way that it is thermo-mechanically as stable as possible even in the high temperature range above 900° C.

It is a further object of the invention to provide a process for the manufacture of a thermal insulating layer which is thermo-mechanically as stable as possible.

In order to satisfy the above and further objects, the invention is characterized by the feature that the thermal insulating layer is shot peened during and/or after the application of the layer by thermal spraying.

In a preferred embodiment, the thermal insulating layer is shot peened with spherically shaped particles which can consist of metal, ceramic or glass.

In accordance with the invention, the thermal insulating layer, is characterized by the feature that the thermal insulating layer has fissures near the surface which are formed by the shot peening.

The invention resides in the feature that the flaking of the thermal insulating layer is avoided by pre-damaging the thermal insulating layer in a defined manner by shot peening with particles. Numerous small fissures near the surface are produced in the thermal insulating layer as a result of the high kinetic energy of the particles. In addition to this, so-called microscopic contact surfaces are broken open which accelerate the sintering process. In this way, sintering effects are reduced and the formation of sub-critical small flakes during segmentation, as a consequence of the many fissure starters, is encouraged during thermo-mechanical stressing.

In contrast to metallic layers, which are made more compact as a result of shot peening heretofore shot peening was always avoided in the case of thermal insulating layers in order not to damage the ceramic material thereof. The latter prohibition also applies to thermal insulating layers that have been manufactured by evaporative coating. The surprising effect, in accordance with the present invention, arises in particular in the case of thermal insulating layers that have been produced by thermal spraying and which exhibit numerous microscopic fissures. As a result of shot peening in accordance with the invention, such a layer is not made compact but, rather, it is broken up in order to avoid problems during sintering.

DETAILED DESCRIPTION

Hereafter, the invention will be described in more detail on the basis of an example of an embodiment in which a thermal insulating layer is applied to a metallic engine component.

EXAMPLE

A thermally highly stressed, metallic engine component, such as a turbine blade, is provided with a ceramic thermal insulating layer by applying the thermal insulating layer on the metallic component by means of plasma spraying. The thermal insulation layer has a porous structure with internal, microscopic fissures. In order to avoid the occurrence of unfavorable flaking in the event of sintering effects at high temperatures exceeding 900° C. during operation, the ceramic thermal insulating layer is pre-damaged in a defined manner by a shot peening operation in which the layer is shot blasted with small metal spheres during or immediately after, formation of the thermally insulated layer. Preferably, the thermally insulated layer is deposited by plasma spraying of the ceramic thermal insulating layer onto the metallic component. As a result of the high kinetic energy of the metallic spheres during shot peening, many small fissures are produced near the surface of the thermal insulating layer during the impacts on the thermal insulating layer by the microscopic blasting particles. The layer is entirely broken up. In addition, so-called microscopic surfaces, which accelerate the sintering process, are broken open. Shot blasting can begin during the application of the thermal insulating layer and then continue during the application of the layer; alternatively, it can begin immediately after the application of the thermal layer.

Although the invention is disclosed with reference to a particular embodiment thereof, it will become apparent to those skilled in the art that numerous modifications and variations can be made which will fall within the scope and spirit of the invention as defined by the attached claims.

What is claimed is:

1. In a process for the manufacture of a thermal insulating layer of ceramic material applied to a metallic component by thermal spraying, the improvement comprising shot peening the thermal insulating layer consisting essentially of ceramic material on said metallic component, said shot peening being conducted under conditions to produce microscopic fissures in a porous surface structure of the thermal insulating layer of ceramic material which prevents sintering and flaking of said layer during operation at high temperatures of about 900° C. or above.

2. The process as claimed in claim 1, wherein said thermal insulating layer is shot peened during and/or after the application thereof to said metallic component.

3. The process as claimed in claim 1, wherein said shot peening of the thermal insulating layer comprises shot blasting said layer with spherically shaped particles.

4. The process as claimed in claim 3, wherein said particles consist of metal, ceramic or glass.

5. The process as claimed in claim 1, wherein said thermal spraying comprises plasma spraying.

6. A thermally insulated metal component comprising a thermal insulating layer consisting essentially of ceramic material applied by thermal spraying on the metal component, said thermal insulating layer having a porous structure with a surface having microscopic fissures formed by shot blasting said surface with microscopic spherical particles, said microscopic fissures providing pre-damage of said surface to prevent sintering and flaking of said layer at temperatures of 900° C. and above.

* * * * *

UNITED STATES PATENT AND TRADEMARK OFFICE

CERTIFICATE OF CORRECTION

PATENT NO. : 6,214,475 B1
DATED : April 10, 2001
INVENTOR(S) : Dr. Joachim Bamberg, et al.

It is certified that error appears in the above-identified patent and that said Letters Patent is hereby corrected as shown below:

Title page,
Item 73, "Daimler-Benz AG" should read -- MTU Aero Engines GmbH --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*